US005444987A

United States Patent [19]

Alsenz

[11] Patent Number: 5,444,987

[45] Date of Patent: Aug. 29, 1995

[54] REFRIGERATION SYSTEM UTILIZING A JET ENTHALPY COMPRESSOR FOR ELEVATING THE SUCTION LINE PRESSURE

[76] Inventor: Richard H. Alsenz, 2402 Creek Meadows, Missouri City, Tex. 77459

[21] Appl. No.: 87,174

[22] Filed: Jul. 2, 1993

[51] Int. Cl.[6] ..... F25B 1/00

[52] U.S. Cl. ..... 62/116; 62/500

[58] Field of Search ..... 62/116, 500, 509, 197

[56] References Cited

U.S. PATENT DOCUMENTS

| | | | |
|---|---|---|---|
| 2,195,604 | 4/1940 | Taylor | 62/500 X |
| 2,519,010 | 8/1950 | Zearfoss | 62/115 |
| 2,576,663 | 11/1951 | Atchison | 62/4 |
| 2,737,031 | 3/1956 | Wulle | 62/117 |
| 3,701,264 | 10/1972 | Newton | 62/500 X |
| 3,864,065 | 2/1975 | Goldsberry | 417/406 |
| 4,442,682 | 5/1984 | Sakata | 62/401 |
| 5,240,384 | 8/1993 | Tuzson | 417/185 |

FOREIGN PATENT DOCUMENTS

| | | | |
|---|---|---|---|
| 1263975 | 10/1986 | U.S.S.R. | 62/500 |

*Primary Examiner*—William E. Wayner

*Attorney, Agent, or Firm*—Conley, Rose & Tayon

[57] ABSTRACT

A refrigeration system which utilizes a portion of the energy of the condensate liquid to elevate the pressure of the gas in the suction line above the evaporator pressure is disclosed. A jet enthalpy compressor is used as a means for elevating the suction line pressure. The refrigeration system contains a reservoir which stores liquid and gas refrigerants. The liquid refrigerant from the reservoir passes to an evaporator wherein it evaporates to a low pressure gas, which is discharged into the suction line. A jet enthalpy compressor is disposed between the reservoir and the suction line. The jet enthalpy compressor contains ejectors, each ejector having a nozzle end placed in the suction line. Gas refrigerant from the reservoir is controllably discharged into the suction line through the nozzle ends of the ejectors to elevate the pressure in the suction line. The gas through the ejectors may be pulsed to further improve the efficiency of the refrigeration system.

17 Claims, 3 Drawing Sheets

REFRIGERATION SYSTEM UTILIZING A JET ENTHALPY COMPRESSOR FOR ELEVATING THE SUCTION LINE PRESSURE

BACKGROUND OF THE INVENTION

1. Field of the Invention

This invention relates generally to a closed loop vapor cycle refrigeration system, and more particularly to a refrigeration system which utilizes energy of the condensate liquid refrigerant to elevate the pressure in the suction line.

2. Description of the Related Art

Most modern refrigeration systems utilize what is known as the vapor compression refrigeration cycle. The efficiency of such refrigeration systems depend upon the losses which occur in such systems and the type of the refrigerant used. Thermo-mechanical expansion valves are typically used to control the flow of the liquid refrigerant to the evaporator of the refrigeration system. The liquid refrigerant passes to the evaporator through the expansion valve, wherein the liquid refrigerant expands. The expansion process at the expansion valve releases thermal energy stored in the liquid refrigerant as kinetic energy of gas molecules. This expansion process is inefficient.

To improve the efficiency of the refrigeration system, temperature of the liquid refrigerant is often lowered so as to lower the thermal energy of the liquid refrigerant before it passes to the expansion valve, thereby decreasing the amount of energy which will have to be removed by the latent evaporation process in the evaporator. A common method employed to lower the temperature of the liquid refrigerant before supplying it to the expansion valve is to store the liquid refrigerant in a receiver or reservoir.

The reservoir, which is at the high pressure side of the refrigeration system, also acts as a liquid-gas separator. The liquid refrigerant from the reservoir is passed to the expansion valve, but the gas in the reservoir remains unutilized. The gas from the reservoir, however, can be removed from the reservoir to lower the pressure in the reservoir. Lowering the pressure in the reservoir further lowers the temperature of the liquid refrigerant in the reservoir before it enters the evaporator, which is not generally done. The gas removed from the reservoir may be used to perform some useful function in the refrigeration system to further improve the refrigeration system efficiency, but is also not generally done.

The present invention provides a refrigeration system wherein energy from the high pressure side of the refrigeration system is used to elevate the pressure in the suction line above the evaporator pressure to improve the overall efficiency of the refrigeration system.

SUMMARY OF THE INVENTION

The present invention provides a closed loop refrigeration system that includes an evaporator for evaporating a liquid refrigerant to a low pressure gas refrigerant and discharging it to a suction line, a system compressor for compressing gas refrigerant from the suction line to a high pressure and high temperature, a condenser for condensing the high pressure and high temperature gas refrigerant into a liquid refrigerant, a reservoir for receiving the refrigerant from the condenser and separating the refrigerant into liquid and gas refrigerants, means for discharging gas refrigerant from the reservoir into the suction line for elevating the pressure in the suction line above the evaporator pressure.

A jet enthalpy compressor is used as a means for discharging high pressure gas from the reservoir into the suction line. The term enthalpy compressor is used herein to define a process which utilizes energy content of the liquid refrigerant to improve the efficiency of the refrigeration system. This invention also provides a novel multi-stage jet enthalpy compressor.

The jet enthalpy compressor may contain one ejector or more than one ejector, with each ejector having a discharge nozzle or jet. The jet enthalpy compressor is disposed between the reservoir and the suction line, with the jets placed in the suction line. High pressure gas from the reservoir is discharged through the jets into the suction line to elevate the pressure in the suction line above the evaporator pressure, i.e., pre-compressing the gas in the suction line before it is compressed by the system compressor. Further efficiency improvement may be obtained by pulsing the high pressure gas from the reservoir through the ejectors.

The method of the invention comprises the steps of: condensing a high pressure gas refrigerant into a liquid refrigerant; expanding a portion of the liquid refrigerant into a gas; evaporating the liquid refrigerant in an evaporator to a low pressure gas and discharging the low pressure gas into a suction line; discharging the expanded gas refrigerant into the suction line in a manner which elevates the pressure in the suction line; and compressing the gas refrigerant from the suction line to the high pressure.

Examples of more important features of the invention have been summarized above rather broadly in order that the detailed description thereof that follows may be better understood, and in order that the contribution to the art may be better appreciated. A more particular description of the invention may be had in reference to the specific embodiments described in the description of preferred embodiments and illustrated in the appended drawings, which drawings form a part of this specification. It is to be noted, however, that detailed description and the drawings describe only the preferred embodiments of the invention and therefore are not to be considered limiting the invention to these specific embodiments as other equally effective embodiments may be designed to encompass the scope of the invention as defined by the appended claims.

BRIEF DESCRIPTION OF THE DRAWINGS

Following is a brief description of the drawings, wherein like elements identified by like numerals.

DESCRIPTION OF THE PREFERRED EMBODIMENTS

Figure 1:
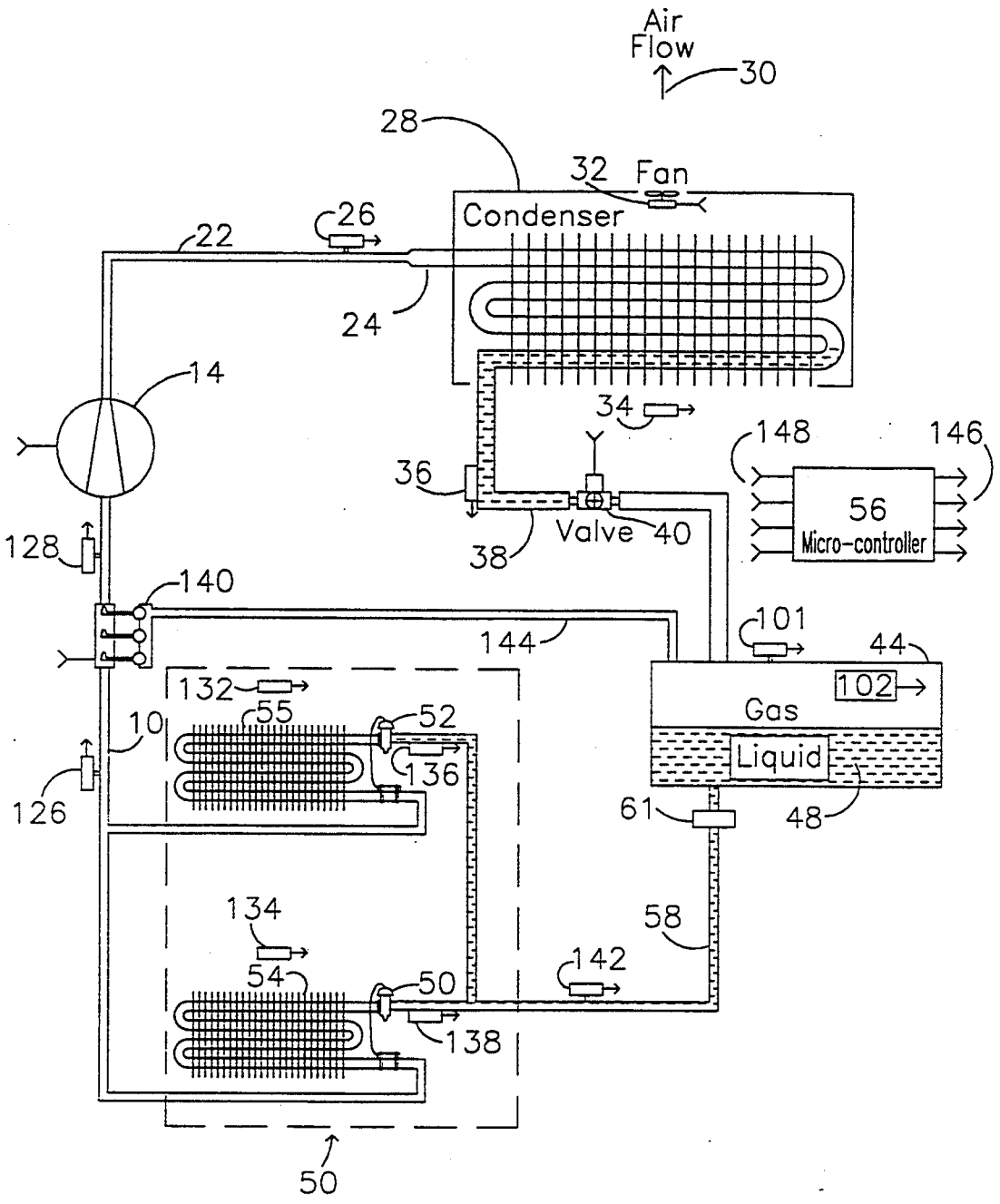
FIG. 1 shows a schematic diagram of a closed loop vapor cycle refrigeration system according to the present invention.

FIG. 1 shows a closed loop vapor cycle refrigeration system according to the present invention. This refrigeration system includes an evaporator system 50 for evaporating a liquid refrigerant into a low pressure gas refrigerant and discharging the low pressure gas into suction line 10, a system or primary compressor 14 for compressing the gas refrigerant leaving the evaporator to a high pressure and high temperature gas refrigerant, a condenser 28 for condensing the high pressure and high temperature gas refrigerant to a liquid refrigerant, a receiver or reservoir 44 for storing liquid and gas refrigerants, a jet enthalpy compressor 140 coupled to the suction line 10 for elevating the pressure of the gas refrigerant in the suction line 10 above the pressure in the evaporator before such gas refrigerant enters the system compressor 14, a number of sensors for providing information about various system parameters, and a control circuit 56 for controlling the operation of the refrigeration system, including the operation of the jet enthalpy compressor 140, in response to information provided by the various sensors and in accordance with instructions programmed in or provided to the control circuit 56.

The system compressor 14 receives gas refrigerant from the suction line 10 and compresses it to a high pressure and high temperature. The high pressure and high temperature gas refrigerant passes to a condenser coil 24 via a line 22. The fan 32 blows air across the condenser coil 24, which removes thermal energy from the refrigerant in the condenser, causing it to condense to a liquid. The fan 32 may be of a fixed speed or variable speed type. The refrigerant from the condenser 28 discharges via a liquid return line 38 into the reservoir 44.

A pressure sensor 26, placed in the line 22, provides signals representative of the pressure of the gas entering the condenser 28. A temperature sensor 36 placed in the liquid return line 38 provides signals representative of the temperature of the refrigerant leaving the condenser 28. A flow control or metering device 40, such as a valve, is placed in the return line 38 to control the flow of the refrigerant from the condenser 28 into the reservoir 44. The reservoir 44 separates the liquid refrigerant from any gas accumulated therein. A liquid level sensor 102 and a pressure sensor 101, placed in the reservoir 44, respectively provide information about the level of the liquid refrigerant and the pressure in the reservoir 44. The liquid refrigerant 48 from the reservoir 44 is pumped by a pump 61 via a line 58 to the evaporator system 50. A pressure sensor 142, placed in the line 58, provides information about the pressure of the refrigerant before it enters the evaporator system 50.

The evaporator system 50 shown in FIG. 1 contains two evaporator coils 54 and 55 by way of example only and not by way of limitation. A flow control device 51 is connected to the inlet end of the evaporator coil 54 for controlling (metering) the liquid refrigerant flow to the evaporator coil 54. Similarly a flow control device 52 is connected to the inlet end of the evaporator coil 55 to meter the flow of the liquid refrigerant to the evaporator coil 55. The flow control device is preferably a pulse modulated expansion valve, although any other suitable device, such as a modulating valve or a stepper motor, may also be used. Liquid refrigerant entering into the evaporator coils 54 and 55 evaporates into a low pressure gas refrigerant, which passes to the system compressor 14 via the suction line 10, completing the vapor refrigeration cycle, which during operation is continuously repeated.

Temperature sensors 132 and 134 are respectively installed in the fixtures being cooled by the coils 54 and 55. Each of the temperature sensors 132 and 134 provides electrical signals representatives of the temperature of its associated fixture. Additionally, temperature sensors 136 and 138 are respectively installed in the coils 54 and 55 for providing signals representative of the temperature of the refrigerant entering their associated evaporator coils.

A jet enthalpy compressor 140 is disposed between the reservoir 44 and the suction line 10 via a line 144 in a manner that allows only gas from the reservoir 44 to enter into the jet enthalpy compressor 140. A pressure sensor 126 is installed in the suction line 10 on the evaporator side of the jet enthalpy compressor 140 and a pressure sensor 128 is installed on the system compressor side of the jet enthalpy compressor 140 for respectively providing signals representative of the pressure of the gas in the suction line before and after the jet enthalpy compressor 140. The operation of the jet enthalpy compressor 140 is described in more detail later in reference to FIG. 2.

The refrigeration system of FIG. 1 contains a control circuit 56, which controls the operation of the entire refrigeration system, including the flow through the flow control devices 40, 51, and 52, the operation of the jet enthalpy compressor 140, system compressor 14, and the fan 32, in response to the information provided by various sensors installed in the refrigeration system and in accordance with programmed instructions provided to the control circuit 56. The control circuit 56 contains, among other things, a micro-controller or microprocessor, analog to digital converters, comparators and switching circuitry. The use of a micro-controller or microprocessor and related circuitry to control devices, such as the elements of the refrigeration system shown in FIG. 1, are well known in the electrical engineering art and, therefore, such circuits are not described in detail herein.

The control circuit 56 is operatively coupled via input ports 148 to temperature sensors 34, 36, 132, 134, 136 and 138, pressure sensors 26, 101, 126, 128 and 142, and the liquid level sensor 102 and via the output ports 146 to the compressor 14, fan 32, flow control devices 40, 51 and 52, pump 61, and the jet enthalpy compressor 140. The outgoing arrows at the sensors and the inward arrows at the control circuit 56 indicate that those sensors are operatively coupled to and provide relevant information (signals) to the control circuit 56. The outgoing arrows at the control circuit 56 and inward arrows at system elements, such as the flow control devices 40, 51 and 52, compressor 14, fan 32, and the jet enthalpy compressor 140, indicate that the control circuit 56 is operatively coupled to and controls the operation of those elements.

The control circuit 56 receives signals from temperature sensors 34, 36, 132, 134, 136 and 138, pressure sensors 26, 101, 126, 128 and 142, liquid level sensor 102, and any other sensor used in the refrigeration system. During operation, the control circuit 56 continually monitors the operation of various system elements, and determines or computes the control criteria defined for the refrigeration system and other system parameters and controls operation of the refrigeration system in accordance with the programmed instructions provided to the control circuit.

Figure 2:
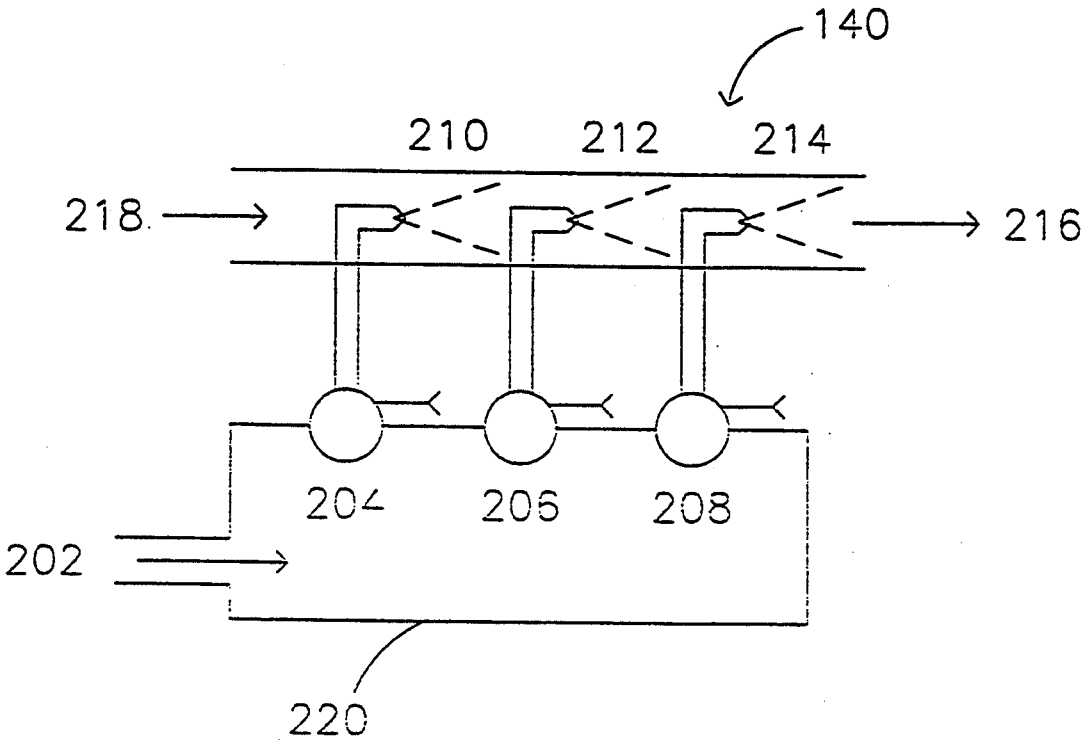
FIG. 2 shows an embodiment of a jet enthalpy compressor for use with the refrigeration system of FIG. 1.

The operation of the jet enthalpy compressor 140 will now be described while referring to FIGS. 1 and 2. The jet enthalpy compressor 140 shown in FIG. 2 contains a chamber 220 and a plurality of serially placed apart ejectors 210, 212, and 214. The inlet end of each ejector is connected to the chamber 220 for receiving gas from the chamber 220. The discharge end of each ejector terminates into a nozzle or jet to provide a jet action to the fluid being discharged therefrom. The jet end of each of the ejector is placed in the suction line 10 in a manner so that gas from the ejectors will discharge in the direction of the gas flowing through the suction line, i.e., from the evaporator system 50 to the system compressor 14. Separate control valves 204, 206, and 208 are respectively coupled to the ejectors 210, 212, and 214 to control the flow of the gas from the chamber 220 to the suction line 10. The control valves 204, 206, and 208 are coupled to the control circuit 56, which controls the operation (opening and closing) of these control valves.

The control valves 40, 204, 206, and 208 normally remain in the closed position, that is, no fluid passes through these valves. During operation, the control valve 40 is periodically opened to discharge a desired amount of the liquid refrigerant from the condenser 28 to the reservoir 44. The control valves 204, 206, and 208 are sequentially opened and closed (pulsed) to discharge the gas from the reservoir 44 to the suction line 10. The pulse rate and the pulse duration is controlled by the control circuit 56.

To operate the jet enthalpy compressor 140, the control valve 204 is opened first. The relatively high energy (pressure or temperature) gas from the chamber 220 discharges through the nozzle 210 into the suction line 10 in the form of a jet stream. The high energy jet stream molecules strike (stimulate) the lower energy gas molecules returning from the evaporator coils 54 and 55, which accelerates the low energy gas molecules in the suction line 10, thereby elevating the pressure of such gas refrigerant in the suction line above the pressure of the gas in the evaporator coils 54 and 55. In this manner, energy is transferred from the high energy molecules of the gas refrigerant received from the reservoir 44 to the lower energy molecules of the gas refrigerant received from the evaporator coils 54 and 55. The control valve 204 is then closed while the control valve 206 is opened. The jet stream from the ejector 212 raises the pressure of the molecules of the gas refrigerant leaving the ejector 210. The control valve 206 is then closed and the control valve 208 is opened to further raise the pressure of the gas refrigerant leaving the ejector 212. This process continues for all ejectors in the jet enthalpy compressor and the cycle is repeated as desired.

The net effect is a successive energy gain by the gas molecules passing across the serially arranged ejectors 210, 212, 214 and the like, and a loss of energy by the high pressure gas molecules from the reservoir, resulting in a higher pressure of the gas refrigerant (indicated by the arrow 216) in the suction line 10 between the last ejector 214 and the system compressor 14 than the pressure of the gas refrigerant (indicated by the arrow 218) in the evaporator coils 54 and 55. Thus, the jet enthalpy compressor, utilizes the high pressure gas from the reservoir 44 to improve the efficiency of the refrigeration system by elevating the pressure of the low pressure gas refrigerant leaving the evaporator system 50 above the evaporator pressure before it enters the system compressor 14 and by lowering the temperature of the liquid refrigerant in the reservoir before it enters the evaporator system 50. Further efficiency gain is obtained by pulse modulating the gas refrigerant through the ejectors.

The jet enthalpy compressor 140 described above is shown to contain three ejectors only as an example and not by way of limitation. It may contain only one ejector or any desired number of ejectors, and such ejectors may or may not be pulsed. Greater efficiency can generally be obtained by staging ejectors and even further gains can be realized by pulsing the ejectors.

Figure 3:
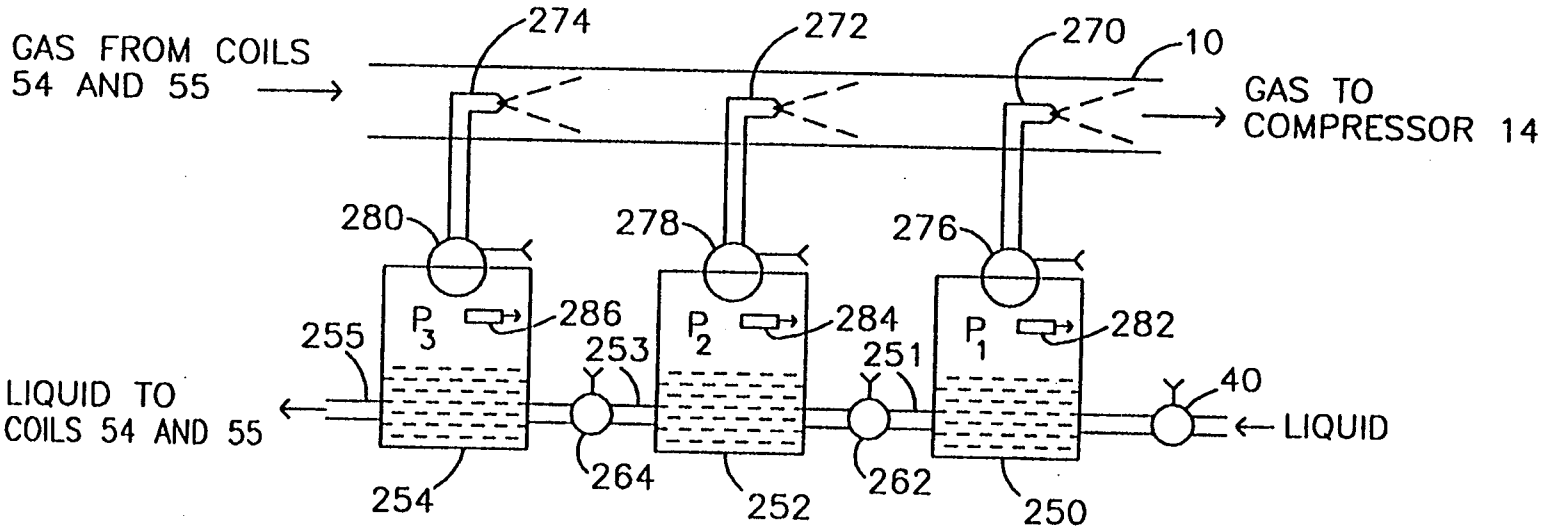
FIG. 3 shows a multi-stage jet enthalpy compressor for use in the refrigeration system of FIG. 1.

FIG. 3 shows an alternate embodiment of the jet enthalpy compressor for use in the refrigeration system of the present invention. FIG. 3 shows a plurality of staged reservoirs 250, 252, and 254. Separate ejectors 270, 272, and 274 are respectively connected between the reservoirs 250, 252, and 254 and the suction line 10. Control valves 276, 278 and 280 control the flow of the gas refrigerant from their associated reservoirs to their associated ejectors 270, 272, and 274. A control valve 262, connected to a line 251 between the reservoir 250 and the reservoir 252, controls the liquid refrigerant flow from the first reservoir 250 to the second reservoir 252. The line 251 is connected near the bottom of each of the reservoirs 250 and 252 to ensure that only liquid passes from the reservoir 250 to the reservoir 252. Similarly, a control valve 264, placed in a line 253 connecting the second reservoirs 252 and the third reservoir 254, controls the liquid refrigerant flow from the reservoir 252 to the reservoir 254. The liquid from the last reservoir 254 passes to the evaporator system of the refrigeration system 50 shown in FIG. 1. Sensors may be installed in each reservoir to provide signals to the control circuit relating to the temperature and pressure of the refrigerant in each such reservoir. All of the control valves and any sensors connected to the various reservoirs are coupled to the control circuit 56 for computing the values of the various system parameters and for controlling the operation of the control valves.

Still referring to FIG. 3, during operation, liquid refrigerant flows from the condenser 38 to the first reservoir 250 and from the first reservoir 250 to the second reservoir 252 and from the second reservoir 252 to the third reservoir 254 and so on to all such reservoirs in the refrigeration system. The amount of the refrigerant flowing from one reservoir to the next is controlled by the control valve coupled in the line between those two reservoirs so as to maintain the liquid refrigerant in each such reservoir at a desired level. Liquid level sensors 282, 284 and 286 are respectively installed in the reservoirs 250, 252 and 254 to provide information respecting the liquid level in their associated reservoir to the control circuit 56. The pressure (P1) in the first reservoir 250 is higher than the pressure (P2) in the second reservoir 252, and the pressure in the second reservoir 252 is higher than the pressure (P3) in the third reservoir 254. During operation, the control valves 280, 278, and 276 are sequentially pulsed to discharge gas from their associated reservoirs into the suction line 10, thereby elevating the pressure of the gas in the suction line before it enters the system compressor.

FIG. 3 shows three reservoir stages by way of examples and not as a limitation. Such a jet enthalpy compressor may contain any number of reservoir stages, each reservoir stage having the same or different number of ejectors.

In summary, the present invention utilizes a portion of the energy of the high temperature condensate liquid to elevate the suction line pressure above the evaporator pressure, i.e., to precompress the gas in the suction line before it enters the system compressor. To accomplish this, a portion of the high temperature condensate liquid is expanded into a gas before such liquid enters into the evaporator. The expanded gas is discharged into the suction line in a manner which elevates the suction line pressure above the evaporator pressure or in other words pre-compresses the gas in the suction line before it is further compressed by the system compressor. The enthalpy jet compressor serves as a means for pre-compressing the low pressure gas leaving the evaporator system.

Elevating the pressure of the gas in the suction line 10 before it enters the system compressor 14 requires a lower compression to be done by the system compressor 14, which improves the efficiency of the refrigeration system. The energy stored in the gas in the reservoir(s), which is on the high pressure side of the refrigeration system, is used to improve the efficiency of the refrigeration system. Typically, this energy is wasted in the prior art refrigeration systems.

Furthermore, the foregoing descriptions are directed to particular embodiments of the invention for the purpose of illustration and explanation. It will be apparent, however, to one skilled in the art that many modifications and changes to the embodiments set forth above are possible without departing from the scope and the spirit of the invention. It is intended that the following claims be interpreted to embrace all such changes and modifications.

What is claimed is:

1. A closed loop refrigeration system, comprising (a) a reservoir containing liquid and gas refrigerants;

(b) an evaporator connected to the reservoir for evaporating the liquid refrigerant from the reservoir into a low pressure gas refrigerant and discharging the low pressure gas refrigerant into a suction line;

(c) a system compressor coupled to the suction line for compressing the gas refrigerant from the suction line to a high pressure gas refrigerant;

(d) a condenser coupled between the system compressor and the reservoir for condensing the high pressure gas refrigerant to the liquid refrigerant;

(e) a control device coupled to the condenser and the reservoir for controlling flow of the refrigerant from the condenser to the reservoir; and (f) a jet enthalpy compressor having a plurality of spaced apart ejectors placed in a series relationship in the suction line, each ejector in said plurality of ejectors adapted to receive gas refrigerant from the reservoir and further adapted to discharge such received gas refrigerant into the suction line in the form of jet streams in the direction of flow of the gas refrigerant in the suction line before the gas refrigerant from the suction line enters the system compressor.

2. A method of pre-compressing a low pressure gas refrigerant leaving an evaporator of a closed loop vapor compression refrigeration system, comprising the steps of:

(a) evaporating a high temperature condensate liquid into the low pressure gas refrigerant and discharging the low pressure gas refrigerant into a suction line;

(b) expanding a portion of the condensate liquid into vapor before evaporating the condensate liquid:

(c) discharging the expanded vapor into the suction line in a manner which elevates the pressure in the suction line above the evaporator pressure;

(d) compressing the gas refrigerant from the suction line to a high temperature; and (e) condensing the high temperature gas refrigerant into the high temperature condensate liquid.

3. A closed loop refrigeration system, comprising:

(a) an evaporator for evaporating a liquid refrigerant into a low pressure gas refrigerant and discharging the low pressure gas refrigerant into a suction line;

(b) a system compressor coupled to the suction line for compressing the gas refrigerant from the suction line to a high pressure gas refrigerant;

(c) a plurality of reservoirs connected to each other in one way liquid communication from a first reservoir to a last reservoir each said reservoir containing therein liquid and gas refrigerants;

(d) at least one separate ejector coupled to each said reservoir for receiving gas refrigerant from its associated reservoir, each said ejector having a jet end placed in the suction line, each said ejector adapted to discharge the gas from its associated reservoir into the suction line through its jet end to elevate the pressure of the gas refrigerant in the suction line before the gas refrigerant from the suction line enters the system compressor.

4. A method of improving the efficiency of a refrigeration system having a reservoir containing therein liquid and gas refrigerants at a high pressure, said method comprising the steps of:

(a) evaporating the liquid refrigerant from the reservoir in an evaporator into a low pressure gas and discharging the low pressure gas into a suction line;

(b) discharging the high pressure gas refrigerant from the reservoir into the suction line through a plurality of serially spaced apart jets so as to accelerate the low pressure gas molecules in the suction line, thereby elevating the pressure of the gas in the suction line above the pressure in the evaporator; and (c) compressing the gas from the suction line.

5. The method as described in claim 4, wherein the high pressure gas from the reservoir is sequentially pulsed through the serially spaced apart ejectors.

6. A method of improving the efficiency of a refrigeration system having a system compressor for compressing gas refrigerant to a high pressure, a condenser for condensing the high pressure gas refrigerant into a liquid refrigerant, means for controlling the liquid refrigerant flow from the condenser to a reservoir, said reservoir containing therein liquid and gas refrigerant, said method comprising the steps of:

(a) evaporating the liquid refrigerant from the reservoir into a low pressure gas and discharging the low pressure gas into a suction line;

(b) stopping the flow of the refrigerant from the condenser to the reservoir;

(c) discharging the intermediate pressure gas from the reservoir into the suction line as a series jet streams in the direction of flow of the refrigerant in the suction line to elevate the pressure of the gas refrigerant in the suction line;

(d) compressing the gas refrigerant from the suction line into a high pressure gas refrigerant; and (e) condensing the high pressure gas refrigerant into the liquid refrigerant and discharging the liquid refrigerant into the reservoir.

7. A refrigeration system, comprising:

(a) a condenser for condensing a high pressure gas refrigerant into a liquid, said condenser discharging the liquid refrigerant into a reservoir, said reservoir expanding a portion of the liquid refrigerant into a gas refrigerant;

(b) an evaporator for evaporating the liquid refrigerant from the reservoir into a low pressure gas refrigerant, said evaporator discharging the low pressure gas refrigerant into a suction line;

(c) a compressor coupled to the suction line for compressing the low pressure gas from the evaporator; and (d) an ejector coupled to the suction line, said ejector discharging the gas refrigerant from the reservoir into the suction line in a manner which elevates the pressure in the suction line above the pressure in the evaporator.

8. A closed loop refrigeration system, comprising:

(a) a condenser for condensing a high pressure gas refrigerant into a liquid, said condenser discharging the liquid refrigerant into a reservoir, said reservoir expanding a portion of the liquid refrigerant therein into a gas refrigerant;

(b) an evaporator for evaporating the liquid refrigerant from the reservoir into a low pressure gas refrigerant and discharging the low pressure gas refrigerant, said evaporator discharging the low pressure gas refrigerant into a suction line;

(c) a compressor coupled to the suction line for compressing the gas refrigerant from the evaporator; and (d) an enthalpy jet compressor coupled to the suction line for discharging the gas refrigerant from the reservoir into the suction line to elevate the pressure of the gas refrigerant in the suction line above the pressure in the evaporator before such gas enters the compressor.

9. The apparatus of claim 8, wherein the enthalpy jet compressor has an ejector with a jet end through which the high pressure gas from the reservoir is discharged into the suction line.

10. The apparatus of claim 8, wherein the enthalpy jet compressor contains a plurality of serially spaced apart ejectors, each such ejector having a jet end placed in the suction line through which the gas from the reservoir is discharged into the suction line.

11. The apparatus of claim 10, wherein the gas from the reservoir is discharged through the ejectors by sequentially pulsing the high pressure gas through the ejectors.

12. The apparatus of claim 10, wherein a flow control device is coupled to each said ejector for separately controlling the flow of the high pressure gas through each said ejector.

13. The apparatus of claim 12, wherein a separate flow control device is coupled to each said ejector for independently controlling the flow of the high pressure gas through each such ejector.

14. The apparatus of claim 13 further having a control circuit coupled to each said control device for controlling the operation of each said flow control device.

15. A closed loop refrigeration system, comprising:

(a) an evaporator for evaporating a liquid refrigerant into a low pressure gas refrigerant and discharging the low pressure gas refrigerant into a suction line;

(c) a system compressor coupled to the suction line for compressing the gas refrigerant from the suction line to a high pressure gas refrigerant;

(e) a jet enthalpy compressor coupled to the suction line for elevating the pressure of the gas refrigerant in the suction line before the gas refrigerant from the suction line enters the system compressor, said jet enthalpy compressor having:

(i) a plurality of reservoirs connected to each other in one way liquid communication from a first reservoir to a last reservoir, each reservoir containing therein liquid and gas refrigerants;

(ii) a liquid flow control device connected between each successive pair of said reservoirs for controlling the flow of the liquid from the first to the last reservoir;

(iv) an ejector coupled in gas communication between each said reservoir and the suction line for discharging gas from the reservoirs to the suction line;

(iii) means for controlling the flow through the ejector.

16. A closed loop refrigeration system, comprising:

(a) an evaporator for evaporating a liquid refrigerant into a low pressure gas refrigerant and discharging the low pressure gas refrigerant into a suction line;

(b) a system compressor coupled to the suction line for compressing the gas refrigerant from the suction line to a high pressure gas refrigerant;

(c) a jet enthalpy compressor coupled to the suction line for elevating the pressure of the gas refrigerant in the suction line before the gas refrigerant from the suction line enters the system compressor, said jet enthalpy compressor having:

(i) a plurality of reservoirs connected to each other in one way liquid communication from a first reservoir to a last reservoir, each reservoir containing therein liquid and gas refrigerants;

(ii) a liquid flow control device connected between each successive pair of said reservoirs for controlling the flow of the liquid from the first to the last reservoir;

(iv) an ejector coupled in gas communication between each said reservoir and the suction line for discharging gas from the reservoirs to the suction line;

(iii) a control valve coupled to the ejector for controlling gas flow therethrough; and (d) a condenser coupled between the system compressor and the first reservoir for condensing the high pressure gas refrigerant from the compressor into a liquid refrigerant and discharging the liquid refrigerant into the first reservoir.

17. The refrigeration system of claim 16, further having a control circuit coupled to each said control valve for independently controlling the operation of each said control valve.

* * * * *